US006086173A

United States Patent [19]

Restell

[11] Patent Number: 6,086,173

[45] Date of Patent: Jul. 11, 2000

[54] COMPUTER KIOSK

[75] Inventor: Mary Elizabeth Restell, Sandhurst, United Kingdom

[73] Assignee: International Computers Limited, London, United Kingdom

[21] Appl. No.: 09/001,030

[22] Filed: Dec. 30, 1997

[30] Foreign Application Priority Data

Jan. 17, 1997 [GB] United Kingdom ..... 9700886

[51] Int. Cl.[7] ..... A47B 81/00

[52] U.S. Cl. ..... 312/223.3; 312/107; 312/239

[58] Field of Search ..... 312/7.2, 223.1, 312/223.2, 223.3, 107, 239

[56] References Cited

U.S. PATENT DOCUMENTS

| | | | |
|---|---|---|---|
| 4,323,291 | 4/1982 | Ball | 312/194 |
| 4,725,106 | 2/1988 | Shields et al. | 312/7.2 X |
| 5,281,018 | 1/1994 | Cullinan | 312/223.2 |
| 5,655,822 | 8/1997 | Roberts et al. | 312/223.3 X |
| 5,655,823 | 8/1997 | Schairbaum | 312/223.3 X |
| 5,702,166 | 12/1997 | Lee | 312/223.3 X |
| 5,746,489 | 5/1998 | Moon | 312/7.2 X |
| 5,806,943 | 9/1998 | Dell et al. | 312/223.3 |
| 5,915,582 | 6/1999 | Coonan | 312/223.3 |

*Primary Examiner*—Peter M. Cuomo
*Assistant Examiner*—Stephen Vu
*Attorney, Agent, or Firm*—Lee, Mann, Smith, McWilliams, Sweeney & Ohlson

[57] ABSTRACT

A computer kiosk comprises a desktop with a main cabinet located under the desktop. A display unit is set into an aperture in the desktop. A pair of pockets, is set into the desktop, one on each side of the display unit, for holding peripheral devices. A pair of bins is mounted under the desktop, adjacent to the pockets, for holding electronic circuits associated with the peripheral devices. This provides a flexible configuration for the kiosk. The main cabinet may be positioned between the bins, with the display unit housed in the main cabinet, or else the main cabinet may be positioned to one side of the bins, with the display unit housed in a separate cabinet positioned between the bins.

10 Claims, 2 Drawing Sheets

COMPUTER KIOSK

BACKGROUND TO THE INVENTION

This invention relates to computer kiosks.

A computer kiosk is a computer system or terminal, including a display unit, built into a free-standing module. Such kiosks may, for example, be used by banks or building societies to give information about products to customers, or to allow customers to perform transactions. The kiosk may also include a printer, for printing out product information or a record of a transaction. It may also include a telephone, to allow the customer to speak to a human advisor.

Such kiosks must be user-friendly, so that they can be used by customers not experienced in the use of computers. Typically, they employ a touch-sensitive display screen, which allows the user to interact with the computer simply by touching areas on the screen, without the need for a keyboard or mouse. Such kiosks must also be robust in their construction, and must fit in visually with their surroundings. For example, a kiosk may be built into a furniture-like unit, including a desktop in which the display screen is set substantially horizontally.

The object of the present invention is to provide a novel, more flexible configuration for such a computer kiosk.

SUMMARY OF THE INVENTION

According to the invention a computer kiosk comprises:

(a) a desktop;

(b) a main cabinet located under the desktop, for holding computer equipment;

(c) a display unit set into the desktop;

(d) a pair of pockets, set into the desktop, one on each side of the display unit, for holding peripheral devices, and (e) a pair of bins, mounted under the desktop, adjacent to the pockets, for holding electronic circuits associated with the peripheral devices.

DESCRIPTION OF AN EMBODIMENT OF THE INVENTION

Two embodiments of the invention will now be described by way of example with reference to the accompanying drawings.

Figure 1:
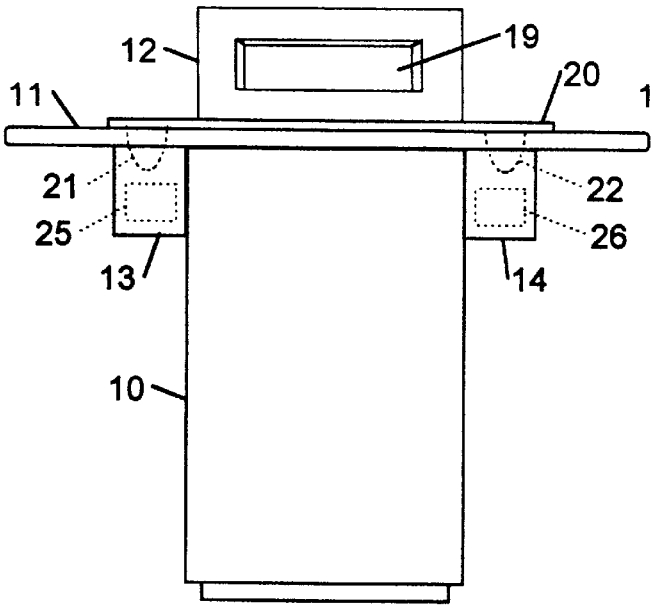
FIG. 1 is a front elevation of a first embodiment of the invention.
Figure 2:
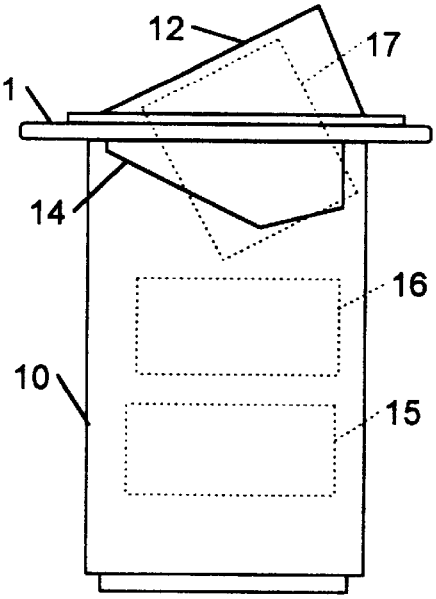
FIG. 2 is a side elevation of the first embodiment of the invention.
Figure 3:
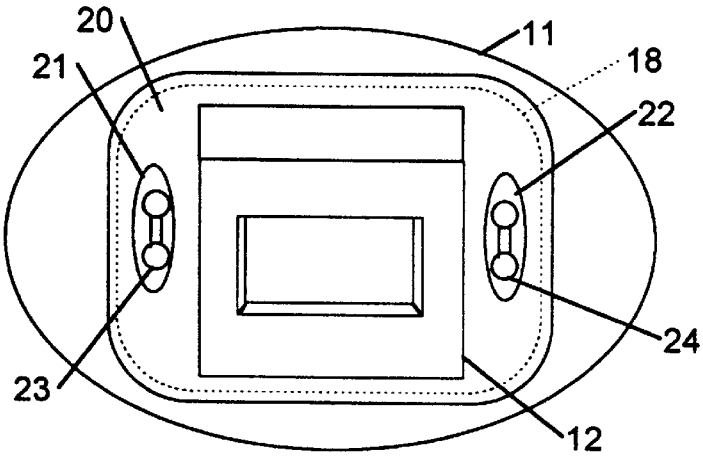
FIG. 3 is a plan view of the first embodiment of the invention.

FIGS. 1 to 3 show a first computer kiosk in accordance with the invention.

The kiosk comprises a main cabinet 10, a desktop 11 located on top of the main cabinet, and a cover 12 located on top of the desktop. The kiosk also includes two open-topped bins 13, 14 which are mounted underneath the desktop, on opposite sides of the main cabinet 10.

The main cabinet 10 holds various components, including a computer processing unit 15, a printer 16, and a display unit 17. A door (not shown) at the front of the cabinet allows access to the components. The printer 16 is arranged to deliver printed sheets through a slot in the desktop by way of a suitable guide (not shown).

The display unit 17 has a touch-sensitive screen, and is mounted in the main cabinet with the screen facing upwards, in a plane inclined at about 30 degrees to the horizontal. The unit extends upwards through an aperture 18 in the desktop 11, so that the screen can be viewed and touched through a window 19 in the cover 12.

The cover 12 has a horizontal flange portion 20 which extends over the aperture 18 in the desktop. This flange portion has two pockets 21, 22 positioned on either side of the display unit, and extending downwards through the aperture 18 into the bins 13, 14. These pockets can be used for various purposes: in the present example, they hold a pair of telephone handsets 23, 24. The bins 13, 14 hold electronic modules 25, 26 associated with the telephone handsets.

Loudspeakers (not shown) are mounted inside the cover 12, above the display unit for sound output from the computer. A video camera (not shown) is also mounted in the cover, above the display unit, to allow two-way videophone calls.

The cover 12 is attached to the desktop by means of hinges (not shown) along its rear edge. This allows the cover to be tilted upwards for access to the display unit 17 and also to the components in the bins 13, 14.

Figure 4:
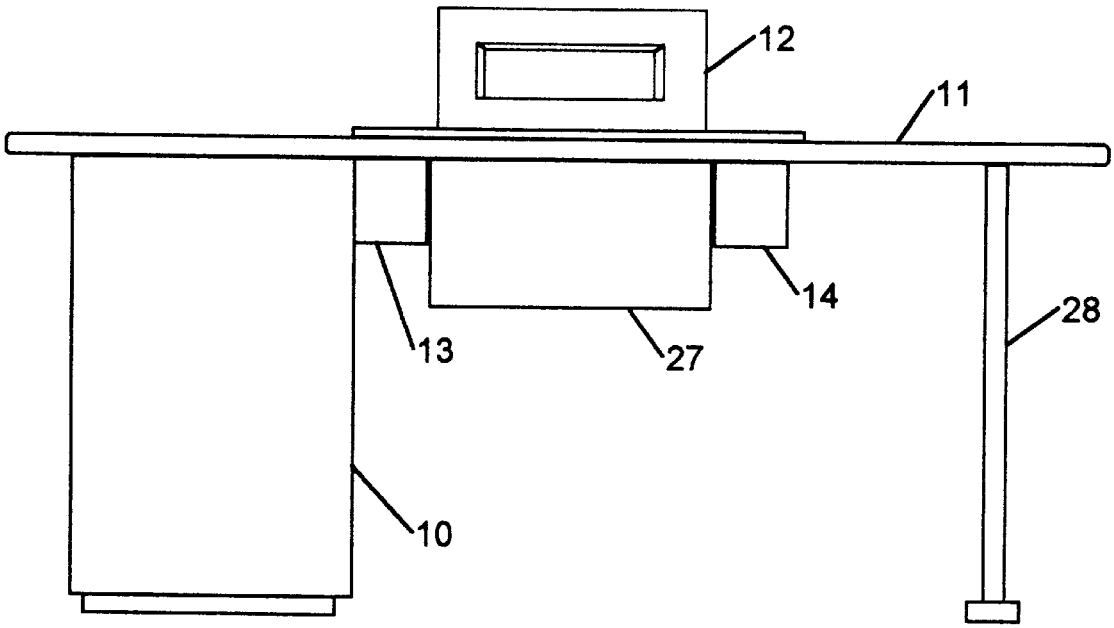
FIG. 4 is a front elevation of a second embodiment of the invention.

FIG. 4 shows another computer kiosk in accordance with the invention. In this case, the desktop 11 is larger, and the main cabinet 10 is repositioned at one side of the desktop. As before, the main cabinet holds a processing unit and printer, and in this case a separate housing 27 is provided for the display unit. A supporting leg 28 is provided at the opposite end of the desktop.

Some Possible Modifications

It will be appreciated that many modifications may be made to the system described above without departing from the scope of the present invention. For example, instead of having two telephone handsets, one of the pockets 21, 22 may be used to house a different peripheral device such as a card reader, or may simply be blanked off and left empty. Also, a keyboard could be provided, mounted in the desktop for example, as an alternative method of user interaction. Furthermore, instead of the desktop being supported by the main cabinet, the desktop may be supported wholly by legs, with the main cabinet suspended from the desktop or mounted on one or more of the legs.

What is claimed is:

1. A computer kiosk comprising:

(a) a desktop;

(b) a main computer equipment cabinet located under the desktop;

(c) a display unit set into an aperture in said desktop;

(d) a cover portion, mounted on top of said desktop and covering said aperture in the desktop, said cover portion having a window through which said display unit can be viewed and having a horizontal flange portion; and (e) at least one pocket, located in said horizontal flange portion.

2. A computer kiosk according to claim 1, further including at least one bin, mounted under the desktop adjacent to said pocket.

3. A computer kiosk according to claim 2 wherein said pocket extends through said desktop into said bin.

4. A computer kiosk according to claim 2, further including at least one electronic circuit housed in said bin.

5. A computer kiosk according to claim 1, further including at least one peripheral device, located in said pocket.

6. A computer kiosk according to claim 5, wherein said peripheral device comprises a telephone handset.

7. A computer kiosk according to claim 1, wherein said display unit is housed in said main cabinet.

8. A computer kiosk comprising:

(a) a desktop;

(b) a main cabinet located under the desktop, for holding computer equipment;

(c) a display unit set into an aperture in the desktop;

(d) a cover portion, mounted on top of the desktop and covering said aperture in the desktop, said cover portion having a window through which said display unit can be viewed and having a horizontal flange portion;

(e) a pair of pockets, set into said horizontal flange portion, one on each side of the display unit, for holding peripheral devices, and (f) a pair of bins, mounted under said desktop, adjacent to said pockets, for holding electronic circuits associated with said peripheral devices.

9. A computer kiosk according to claim 8 wherein said main cabinet is positioned between said bins, and said display unit is housed in said main cabinet.

10. A computer kiosk according to claim 8 wherein said peripheral devices include a telephone handset.

* * * * *